US008161879B1

(12) United States Patent
Pattison

(10) Patent No.: US 8,161,879 B1
(45) Date of Patent: Apr. 24, 2012

(54) METHODS AND APPARATUS FOR SENSING ACCELERATION

(75) Inventor: John Pattison, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 352 days.

(21) Appl. No.: 12/432,358

(22) Filed: Apr. 29, 2009

Related U.S. Application Data

(60) Provisional application No. 61/049,098, filed on Apr. 30, 2008.

(51) Int. Cl.
*F42C 15/24* (2006.01)
*F42C 15/40* (2006.01)

(52) U.S. Cl. ..... 102/262; 102/263; 102/247

(58) Field of Classification Search ..... 102/262, 102/263, 221, 222, 223, 224, 247
See application file for complete search history.

(56) References Cited

U.S. PATENT DOCUMENTS

| | | | | |
|---|---|---|---|---|
| 3,257,529 | A | 6/1966 | Lindberg, Jr. | |
| 3,455,148 | A | 7/1969 | Foster et al. | |
| 3,524,031 | A | 8/1970 | Mack | |
| 3,553,482 | A | 1/1971 | Tavis | |
| 3,764,820 | A | 10/1973 | Sullivan et al. | |
| 3,931,764 | A * | 1/1976 | Malisch et al. | 102/206 |
| 5,141,229 | A | 8/1992 | Roundy | |
| 5,567,880 | A | 10/1996 | Yokota et al. | |
| 2003/0070571 | A1 | 4/2003 | Hodge et al. | |
| 2006/0227984 | A1 | 10/2006 | Sinclair | |

* cited by examiner

*Primary Examiner* — James Bergin
(74) *Attorney, Agent, or Firm* — Eric A. Gifford

(57) ABSTRACT

Methods and apparatus for sensing acceleration according to various aspects of the present invention comprises a non-rigid membrane and a switching latch electrically coupled to the membrane. The membrane is responsive to acceleration forces and is configured to produce a signal as a result of deflections in the membrane caused by acceleration. The signal is transmitted to the switching latch causing a change in state of the switching latch. This change in state allows a second signal to be sent to an activating device such as a squib.

16 Claims, 9 Drawing Sheets

METHODS AND APPARATUS FOR SENSING ACCELERATION

CROSS-REFERENCE TO RELATED APPLICATIONS

This application claims the benefit of U.S. Provisional Patent Application No. 61/049,098, filed on Apr. 30, 2008, and incorporates the disclosure of the application in its entirety by reference.

BACKGROUND OF INVENTION

Projectiles that are launched from a gun, canon or other high energy type of firing device experience extremely high acceleration forces during the launch period and while traveling towards the target. These forces can exceed 80,000 g during the initial stages of launch. It is often desired that a munition or warhead within the projectile not arm until the projectile is traveling at a high velocity and/or it has reached a safe distance from the launch location. Various methods are used to arm a munition. A common method uses mechanical acceleration sensors, or g-switches, to activate a squib which in turn energizes a battery used to arm the munition after launch. Unfortunately, many common acceleration sensors experience failures due to faults of the switching device. A failure in the switch prevents the squib from activating the battery resulting in a mission loss. Additionally, most of the devices used to activate the squib lack testability further reducing the odds of finding a faulty switch.

SUMMARY OF THE INVENTION

Methods and apparatus for sensing acceleration according to various aspects of the present invention comprises a non-rigid membrane and a switching latch electrically coupled to the membrane. The membrane is responsive to acceleration forces and is configured to produce a signal as a result of deflections to the membrane caused by acceleration. The signal is transmitted to the switching latch causing a change in state of the switching latch. This change in state allows a second signal to be sent to an activating device such as a squib which energizes a battery and ultimately arms a munition.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks may be realized by any number of hardware or software components configured to perform the specified functions and achieve the various results. For example, the present invention may employ various accelerometers, e.g., piezoelectric crystals, electret microphones, piezoelectric film, and the like, which may carry out a variety of functions. In addition, the present invention may be practiced in conjunction with any number of acceleration sensing and switching devices, such as those for projectiles, missiles, rockets or any high acceleration device, and the system described is merely one exemplary application for the invention. Further, the present invention may employ any number of conventional techniques for connecting electrical components, restricting current to a circuit, sensing acceleration, and the like.

Figure 1:
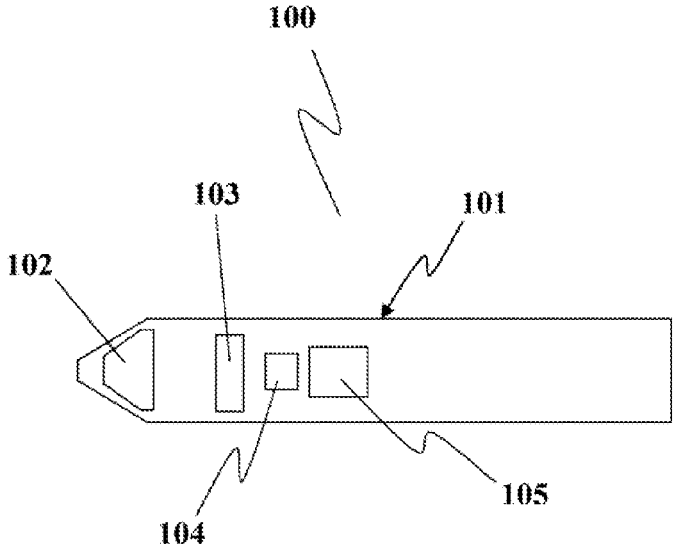
FIG. 1 representatively illustrates a projectile.

Various representative implementations of the present invention may be applied to any system for responding to or sensing the acceleration of a projectile. Certain representative implementations may include, for example: mid range projectiles, guided projectiles, long range projectiles, rockets or missiles. The methods and apparatus for sensing acceleration may operate in conjunction with a projectile 100. Referring now to FIG. 1, the projectile 100 according to various aspects of the present invention may comprise a case 101, a munition 102, a battery 103, a squib 104 and a switch circuit 105. The squib 104 may be disposed between the battery 103 and the switch circuit 105 to prevent undesired or premature activation of the battery 103.

The munition 102, the battery 103, the squib 104 and the switch circuit 105 are disposed within the case 101. The case 101 may also perform any additional function applicable to the operation of the projectile 100, such as allowing the projectile 100 to be safely handled, providing an aerodynamic housing over the elements, and protecting other internal components such as a propulsion system and/or a directional guidance system from exterior damage. The case 101 can be made of any material, such as metal, ceramic, carbon fiber, plastic or other material that sufficiently meets the requirements of a given use.

The munition 102 may comprise explosive or incendiary elements designed to detonate when the projectile 100 has reached its target. The munition 102 may also comprise a kinetic energy penetrator which does not detonate but hits the target with a large amount of force. The munition may further comprise a fuze suitably configured to activate the munition in any appropriate manner, e.g., a timed fuze, contact detonator, proximity fuze, altitude fuze, or remote detonation.

Referring again to FIG. 1, the battery 103 provides power to the munition 102 and/or other systems within the projectile 100 such as guidance or tracking systems that may be included with the projectile 100. The battery 103 may comprise any suitable system capable of providing an energy source, such as a thermal battery, an electric battery, or a capacitive element. For example, in one exemplary embodiment, the battery 103 comprises an electrically activated thermal battery that is operably connected to the munition 102. The battery 103 may also be connected to the squib 104 through an electrical connection such as a wire or a printed circuit board. The squib 104 may also be mounted directly to the terminals of the battery 103. The battery 103 may, however, be configured in any suitable manner to provide power to the munition 102 or other onboard systems.

The squib 104 activates the battery 103 allowing electrical power to be supplied to the munition and/or other onboard systems. The squib 104 may comprise any system capable of activating the battery 103, such as applying energy to the battery 103 terminals, initiating a chemical reaction, or applying a mechanical force to the battery 103. For example, in one embodiment, the squib 104 comprises an electrically heated igniter adapted to apply energy to the battery 103 terminals activating a thermal reaction inside the battery 103 thereby allowing the battery to provide electrical power. In addition to being connected to the battery 103, the squib 104 may be connected to the switch circuit 105 in any suitable manner such as with electrical wiring. The switch circuit 105 may be configured to activate the squib 104 upon the happening of an event such as exceeding a predefined level of accelerative forces, elapse of time, or the like.

Figure 2:
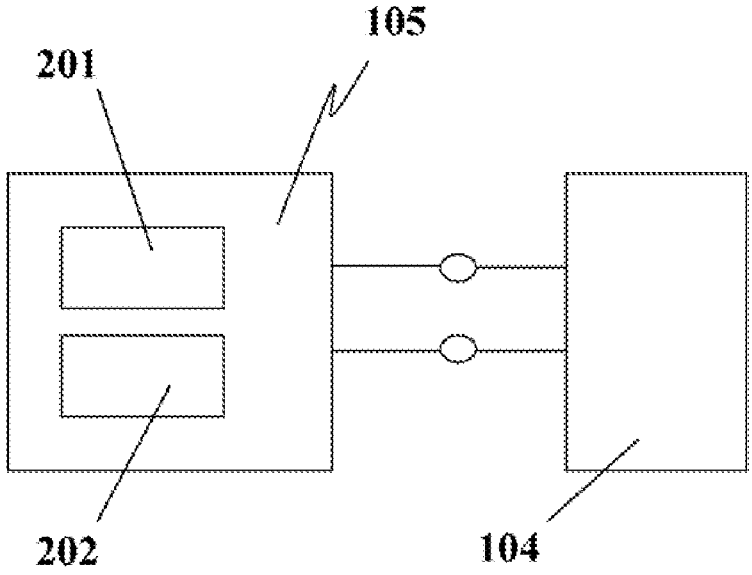
FIG. 2 representatively illustrates a switching circuit and a squib.

The switch circuit 105 prevents undesired activation of the squib 104. For example, referring now to FIG. 2, the switch circuit 105 controls a current applied to the squib 104. In the present embodiment, the switch circuit 105 is responsive to changes in acceleration of the projectile 100. The switch circuit 105 may comprise any suitable system for sensing acceleration and regulating a signal sent to the squib 104. Acceleration sensing may be accomplished by any suitable apparatus such as an accelerometer, motion sensor, or any other possible acceleration sensing component. In addition, the switch circuit 105 need not operate solely with the squib 104 and battery 103, but could be also used as an acceleration sensing circuit for other devices, such as a guidance computer.

Furthermore, the switch circuit 105 may regulate the signal to the squib 104 in any suitable manner. For example, regulation of an electrical current may be performed by using a switch connected to separate circuits, a transistor, diodes, or any type of device which only allows electrical current to flow to the squib 104 in response to changes in acceleration. In another embodiment, the switch circuit 105 may comprise a latch 201 and an accelerometer 202 electrically connected to the squib 104.

Figure 3A:
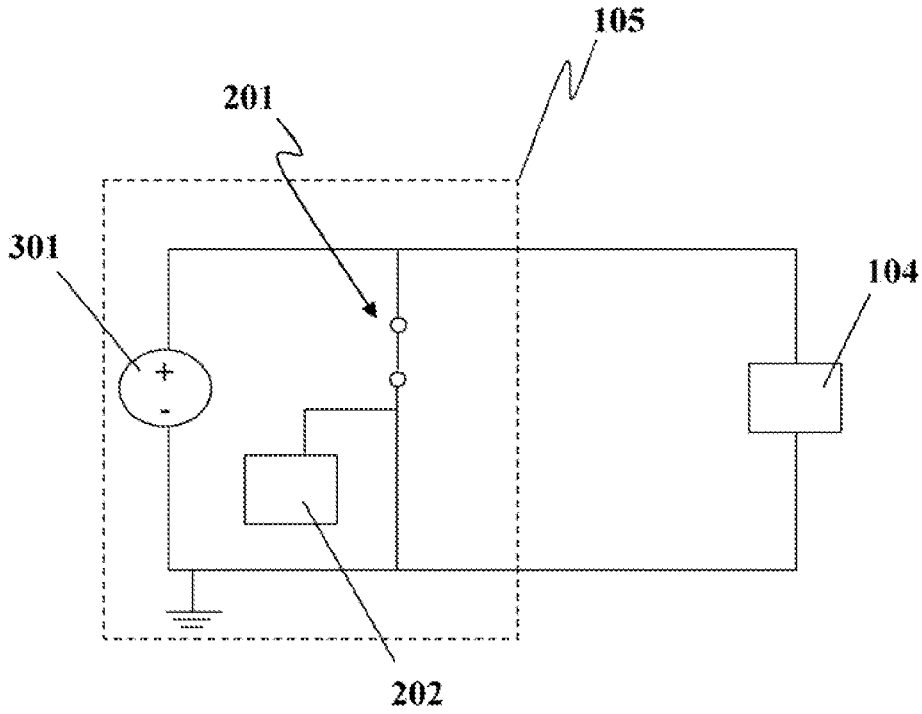
FIG. 3A representatively illustrates an energy storage device implementation and a switch circuit in the grounded position.
Figure 3B:
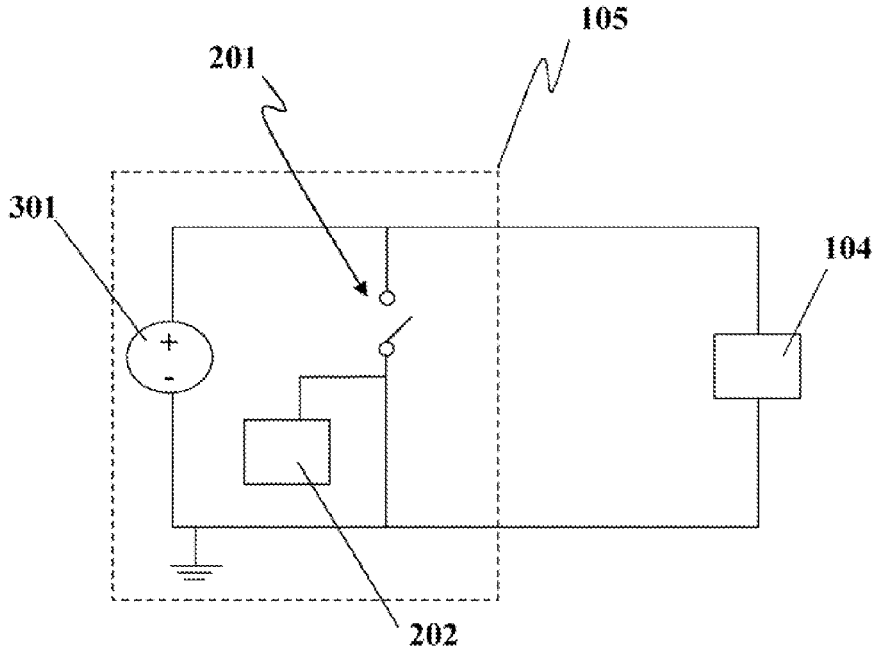
FIG. 3B representatively illustrates an energy storage device implementation and a switch circuit in the open position.

Referring now to FIGS. 3A and 3B, in another embodiment an energy storage device 301 may be connected in parallel with the squib 104 and the switch circuit 105 comprising the latch 201 and the accelerometer 202. The energy storage device 301 may comprise any component with the ability to provide power, such as a battery or capacitive element. In this embodiment the energy storage device 301 is separate from the accelerometer 202 and the latch 201, but it may be integrated within another component such as the accelerometer 202. The energy storage device 301 may be an alternative source of power for the switch circuit 105 or it may comprise a way of providing a signal to the squib 104 causing it to activate. For example, the accelerometer 202 may open the latch 201 thereby allowing the energy storage device 301 to supply the signal to the squib 104. Alternatively, both the energy storage device 301 and the accelerometer 202 may be used in tandem to apply a signal to the squib 104 that reaches an activation level of the squib 104. In addition, the energy storage device 301 may operate to supply power to any other components that might be included within projectile 100.

Figure 4:
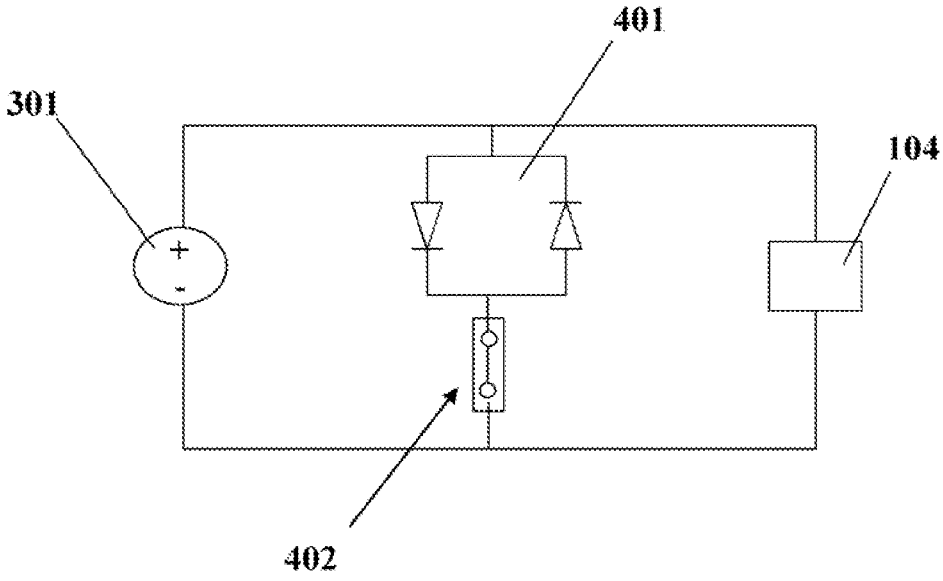
FIG. 4 representatively illustrates a diode implementation.

Referring now to FIG. 4, in yet another embodiment, the switch circuit 105 may comprise a latch open g-switch 402 and two diodes 401 or diode like devices that limit current flow to one direction. The diodes 401 are electrically connected to both the squib 104 and the latch open g-switch 402 and are in parallel with each other. The diodes 401 restrict current above or near the activation level of the squib 104. The diodes 401 allow the squib to be tested without the risk of detonating the squib 104. In addition, the diodes 401 allow the battery 103 and squib 104 to be tested or handled without placing a shorting wire across the squib 104. The latch open g-switch 402 in this embodiment is connected to the squib 104 through the diodes 401. In an exemplary embodiment the latch open g-switch 402 is connected to the squib 104 in parallel and is in series with the diodes 401, but the components may be implemented in any suitable method allowing a restriction of the current to the squib 104. In an alternative embodiment any suitable device capable of restricting current, such as a transistor could be used.

Figure 5:
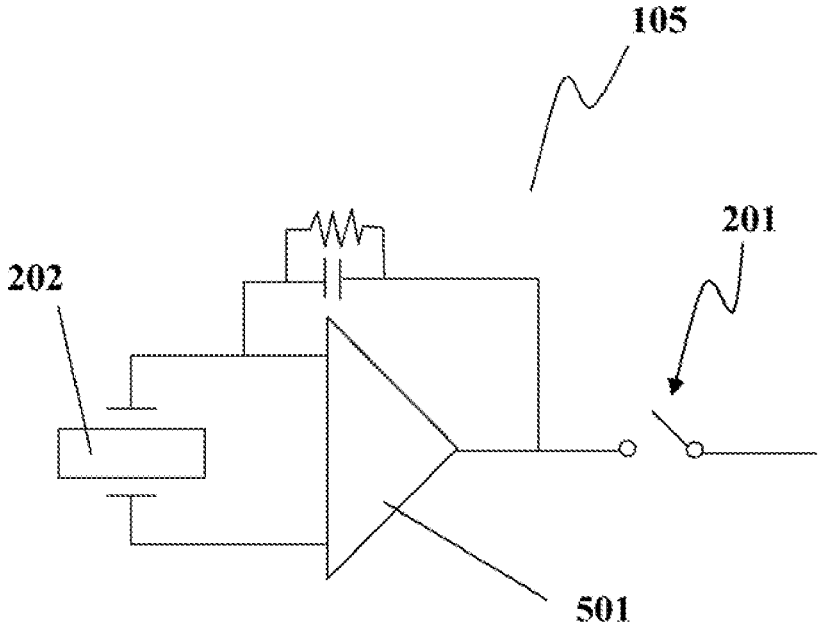
FIG. 5 representatively illustrates the use of an amplifier to increase a signal strength.

Referring now to FIG. 5 another embodiment of the switch circuit 105 may comprise the latch 201, the accelerometer 202 and an amplifier 501. Depending on the type of accelerometer 202 or the strength of the signal produced by the accelerometer 202, the amplifier 501 may be utilized to amplify the signal strength. For example, an accelerometer 202 comprising a thin diaphragm may produce a signal that may not be strong enough to operate the latch 201 or activate the squib 104. The latch 201 and the accelerometer 202 may be connected in the same manner as previous embodiments, but in addition both may be electrically connected to the amplifier 501. For example, the amplifier 501 may be connected between the latch 201 and the accelerometer 202. Alternatively, any system may be used to increase the power of the signal from the accelerometer 202, such as a transistor or integrated circuit. The amplifier 501 may comprise a separate component or it may be integrated into the accelerometer 202.

The latch 201 comprises any system or method which can operate as a switch for a circuit, such as a transistor, a diode, a membrane switch, or any type of switching device. In one representative embodiment, the latch 201 may comprise a mechanical fuze configured to open under forces associated with the launching of the projectile 100. In addition, the latch 201 allows the switch circuit 105 to transmit a signal from the accelerometer 202 to the squib 104, and its function may be performed in any manner, such as incorporating two separate circuits, a diode or transistor between the accelerometer 202 and the squib 104.

For example, in the present embodiment, the latch 201 transitions the switch circuit 105 from a first state to a second state. Referring now to FIGS. 3A and 3B, in the first state, electrical current is shorted to ground and prevented from reaching the squib 104. When the switch circuit 105, transitions to the second state, the electrical current flows to the squib 104. However, the first and second states may be designed in any way to control current flow to the squib 104, for example the first state may allow current flow to the squib 104 while the second state restricts current flow to the squib 104. The latch 201 is connected to the accelerometer 202 through an electrical connection such as a printed circuit board or wire. In the present embodiment the switch circuit 105 is connected to the squib 104 in parallel. The latch 201 and accelerometer 202 may, however, be configured in any suitable manner to prevent the squib 104 from initiating until a predetermined event such as the projectile 100 exceeding a threshold level of acceleration.

The accelerometer 202 comprises any system which may sense acceleration of the projectile 100. In addition, the accelerometer 202 may further comprise an apparatus which produces a signal, such as a voltage, proportional to the level of acceleration. For example, the accelerometer may comprise elements such as ceramic capacitors, ceramic oscillators, or piezoelectric crystals. In one embodiment the accelerometer 202 may comprise a non-rigid membrane configured to produce a signal when subjected to acceleration forces such as those imparted on the projectile 100 during launch. The signal may be produced in any way, for example, the membrane may comprise a diaphragm suitably adapted to deflect when subjected to forces of acceleration. The deflection of the diaphragm may generate the signal or another component such as an integrated circuit or transistor may produce the signal. The signal may either be strong enough to trigger a change in state of the latch 201 and initiate the squib 104 on its own, or the signal may require amplification. In an alternative embodiment, the accelerometer may comprise a cantilever beam, laser, optical, or any other type of accelerometer which senses acceleration or movement and outputs a signal in response to the sensed force. In addition, the accelerometer 202 may be used by any other device or system needing a signal based on acceleration and may operate without the latch 201.

Figure 6:
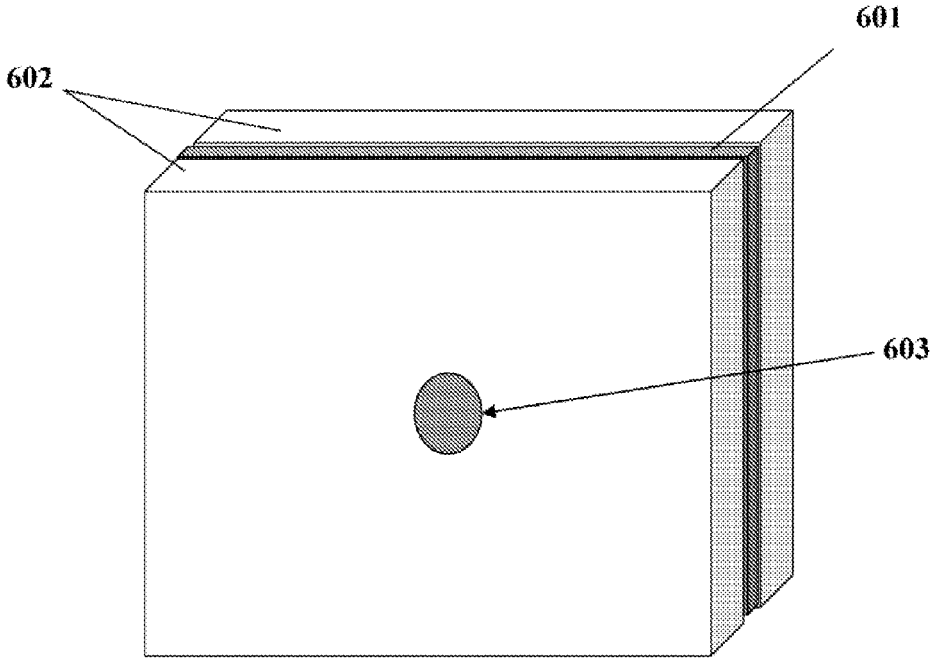
FIG. 6 representatively illustrates a piezoelectric film accelerometer.

Referring now to FIG. 6, in one embodiment the accelerometer 202 may comprise a piezoelectric film 601 bonded between two printed circuit boards 602. The circuit boards 602 are configured with holes in the same location and the film 501 is placed between the boards 502 creating the diaphragm 603. The piezoelectric film 601 comprises a low mass material suitably adapted to withstand shock and acceleration forces associated with launch of the projectile 100. When the diaphragm 603 is subjected to acceleration, such as during launch, the piezoelectric film 601 produces a voltage which increases proportionally with the acceleration of the projectile 100. Alternatively, the diaphragm 603 may be created with any type of conductive material in place of printed circuit boards. For example, piezoelectric crystals may be electrically connected to the latch 201 without the need for printed circuit boards 503.

Figure 7:
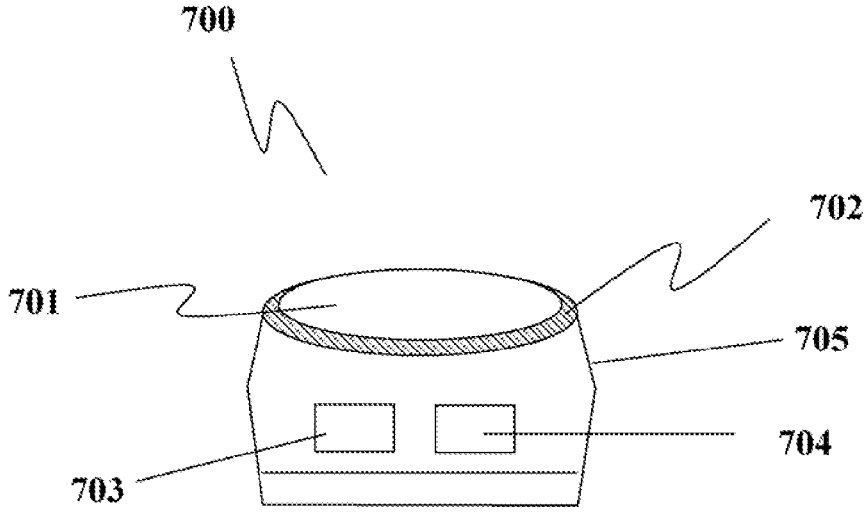
FIG. 7 representatively illustrates an electret microphone accelerometer.

Referring now to FIG. 7, in another embodiment, the accelerometer 202 may comprise a thin polymer foil 701 bonded to a rigid ring 702 forming an electret microphone 700. The electret microphone 700 may be required to create a signal proportional to the level of acceleration felt by the electret microphone 700 when subjected to launch shock of the projectile 100 which can be upwards of 80,000 g. The polymer foil 701 comprises a low mass diaphragm of dielectric material with a permanent charge and the rigid ring 702 may comprise any suitable material such as steel.

The electret microphone 700 may further comprise a field effect transistor (FET) amplifier 703, a pickup electrode 704, and an encasing shell 705. The encasing shell 705 surrounds the FET amplifier 703 and the pickup electrode 704 and is connected to the rigid ring 702. The polymer foil 701 may be disposed between the encasing shell 705 and the rigid ring 702. The polymer foil 701 and the encasing shell 705 may bonded to the rigid ring 702 by any suitable method such as a weld, compression fit, adhesive, fasteners, or the like.

The electret microphone 700 may be configured in any suitable way to provide the signal when the polymer foil 701 is deflected during acceleration of the projectile 100. In the present embodiment the FET amplifier 703 and the pickup electrode 704 receive the signal from the polymer foil 701. In an alternative embodiment, the polymer foil 701 may be directly connected to the latch 201 and transmit the signal without the need for signal amplification.

Figure 8:
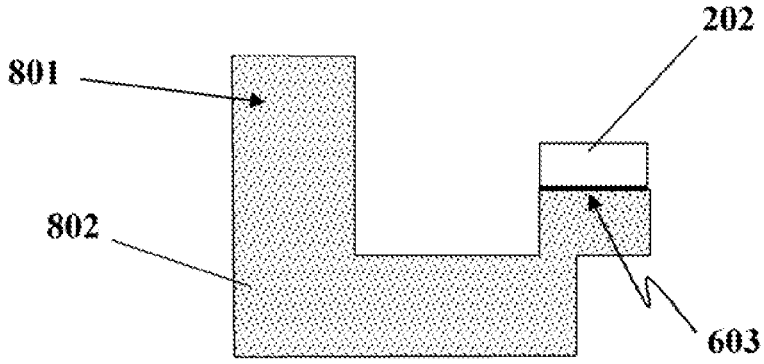
FIG. 8 representatively illustrates the use of an enclosed volume of gas to control pressure forces on one side of a diaphragm.

Referring now to FIG. 8, the accelerometer 202 may further be coupled to a volume of gas 801 disposed on one side of the diaphragm 603. A trapped column of gas 801 ported to one side of the diaphragm 603 may be used to increase or decrease the effective inertial mass of the diaphragm 603 allowing the sensitivity of the accelerometer 202 to be adjusted based on a particular use or expected level of acceleration during launch of the projectile 100. The gas 801 may be contained within a chamber 802 and may comprise any non reactive moisture-free gas, such as nitrogen or helium. The gas 801 may however comprise any suitable gas for a given application.

The alternative embodiments listed above in FIGS. 2-8 are functional in any combination, and may be implemented together or separate. For example, the switch circuit 105 may operate with the diodes 401, the energy storage device 301 and the electret microphone 700 or may operate with the amplifier 501 and the piezoelectric film 601. There are multiple functional implementations that may be created using the alternative embodiments. In addition, the embodiments illustrated are merely exemplary and the invention may be actualized in many ways.

In operation, when the projectile 100 is subjected to an acceleration, the switch circuit 105 produces a signal thereby initiating the squib 104. The signal may be created in any appropriate manner such as by a deflection of an accelerometer 202, relaying the signal from the energy storage device 301, amplifying the signal produced by the accelerometer 202 with the amplifier 501, or in any other suitable manner.

Referring to FIG. 3A of the present embodiment, prior to launch of the projectile 100, the switch circuit 105 may be in a first state wherein the switch circuit 105 is closed and any existing electrical current is sent to ground as opposed to the squib 104. Referring now to FIG. 3B, when the projectile 100 is launched, the accelerometer 202 senses the acceleration of the projectile 100 and the switch circuit 105 transitions from the first state to a second state. The switch circuit 105 changes states when the accelerometer 202 produces a signal in response to a sensed acceleration of the projectile 100 in excess of a predetermined level. The acceleration forces resulting from launch cause a diaphragm 603 within the accelerometer 202 to deflect. This deflection produces a signal, such as a voltage, through either the inherent nature of the diaphragm material or through a circuit which translates the deflection into a voltage. The signal is then sent to the latch 201 causing it to open. Current then flows to the squib 104, the squib 104 subsequently energizes or activates the battery 103 ultimately powering the munition 102 and/or any other onboard systems.

The mere existence of the voltage on the latch 201 may not cause it to open. Instead, the level of the signal or voltage may be directly proportional to the amount of deflection experienced by the diaphragm 603. Alternatively, the signal produced by the accelerometer 202 may need to be amplified in order to trigger the latch 201. In this way, the latch 201 may be kept from inadvertently opening until the signal has reached a predetermined threshold level.

Once the switch circuit 105 has transitioned to the second state current is allowed to flow to the squib 104. The squib 104 may also be configured such that the existence of a current does not result in immediate activation. For example, in one embodiment, the squib 104 may be suitably configured to ignite only after receiving a current of 3.5 amps for 10 milliseconds. In an alternative embodiment, the squib 104 may be configured to fire in response to a total amount of energy delivered rather than a specific minimum current over a period of time. This would allow the use of a decaying pulse rather than a constantly supplied current. The squib 104 and switching circuit 105 may also be designed in such a way as to provide enough current to initiate the squib 104 only after the projectile 100 has reached a specified velocity and/or distance from the target.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. A switch circuit, comprising:

an accelerometer comprising a non-rigid membrane configured to generate a signal in response to a displacement of the non-rigid membrane caused by an acceleration of the switch circuit, wherein the signal proportional to a level of displacement of the non-rigid membrane;

a latch in communication with the accelerometer and configured to transition from a first state to a second state in response to the signal, wherein:

the latch inhibits transmission of an electrical current above a predetermined threshold out of the switch circuit in the first state; and the latch does not inhibit transmission of the electrical current out of the switch circuit in the second state; and a chamber coupled to the accelerometer and disposed on a first side of the non-rigid membrane wherein the chamber forms an enclosed volume of gas for controlling sensitivity of the accelerometer to the acceleration by adjusting an effective inertial mass of the non-rigid membrane.

2. A switch circuit according to claim 1, wherein the membrane comprises a diaphragm.

3. A switch circuit according to claim 2, wherein the diaphragm comprises a piezoelectric material bonded to a conductive medium.

4. A switch circuit according to claim 2, wherein the diaphragm comprises an electret microphone.

5. A switch circuit according to claim 1, further comprising an amplifier adapted to amplify the signal generated by the accelerometer.

6. A switch circuit according to claim 1, wherein the accelerometer is configured to withstand at least 6,000 g.

7. A switch circuit according to claim 1, further comprising an energy storage device coupled to the latch and configured to provide the electrical current to the latch.

8. A switch circuit according to claim 1, further comprising a diode configured to limit a voltage transmission out of the circuit.

9. A switch device for selectively arming a munition in a projectile, comprising:

an accelerometer comprising a deflective element configured to produce a signal in response to a displacement of the deflective element caused by an acceleration of the switch device, wherein the signal is proportional to a level of displacement of the deflective element;

a latch electrically coupled to the accelerometer, wherein:

the latch allows an electrical current to exit the switch when the latch is in a first state and inhibits transmission of the electrical current when the latch is in a second state; and the latch transitions between states in response to the signal; and a chamber coupled to the accelerometer and disposed on a first side of the deflective element, wherein the chamber forms an enclosed volume of gas for controlling sensitivity of the accelerometer to the acceleration by adjusting an effective inertial mass of the deflective element.

10. A switch device according to claim 9, wherein the deflective element comprises a diaphragm.

11. A switch device according to claim 10, wherein the diaphragm comprises a piezoelectric material bonded to a conductive medium.

12. A switch device according to claim 10, wherein the diaphragm comprises an electret microphone.

13. A switch circuit according to claim 9, further comprising an amplifier adapted to amplify the signal generated by the accelerometer.

14. A switch device according to claim 9, further comprising an energy storage device coupled to the latch and configured to provide the electrical current to the latch.

15. A switch apparatus according to claim 9, wherein the accelerometer is configured to withstand at least 6,000 g.

16. A switch apparatus according to claim 9, further comprising a diode, responsive to the switch, wherein the diode inhibits a voltage transmission above a predetermined threshold when the latch is in the second state.

* * * * *